United States Patent [19]

Schroeder

[11] Patent Number: 4,708,413

[45] Date of Patent: Nov. 24, 1987

[54] ELECTRICAL CONNECTOR WITH POSITION ASSURANCE AND ASSIST

[75] Inventor: Diane M. Schroeder, Ravenna, Ohio

[73] Assignee: General Motors Corporation, Detroit, Mich.

[21] Appl. No.: 842,196

[22] Filed: Mar. 21, 1986

[51] Int. Cl.[4] ..... H01R 13/631

[52] U.S. Cl. ..... 439/358

[58] Field of Search ..... 339/91, 82

[56] References Cited

U.S. PATENT DOCUMENTS

| | | | |
|---|---|---|---|
| 3,179,738 | 4/1965 | De Lyon | 339/91 R |
| 3,467,942 | 9/1969 | Dell et al. | 339/49 |
| 3,588,784 | 6/1971 | Kunkle et al. | 339/91 R |
| 3,688,243 | 8/1972 | Yamada et al. | 339/91 R |
| 3,713,076 | 1/1973 | Gabrielian et al. | 339/91 R |
| 4,370,013 | 1/1983 | Niitsu et al. | 339/91 R |
| 4,448,467 | 5/1984 | Weidler | 339/91 R |

FOREIGN PATENT DOCUMENTS

| | | | |
|---|---|---|---|
| 642850 | 1/1964 | Belgium . | |
| 1491731 | 10/1967 | France . | |
| 2447105 | 8/1980 | France | 339/91 R |

*Primary Examiner*—John McQuade

*Attorney, Agent, or Firm*—Patrick M. Griffin

[57] ABSTRACT

An electrical connector having a pair of matable connector bodies with a pump handle type of lock is improved by the addition of a CPA that both disables the lock from releasing, and also pushes the connector bodies together to the fully mated position if they are only partially mated. A blocking end of the CPA is sized so as to be pushed beneath and be retained beneath the operating end of the arm of the lock, thereby preventing it from being pressed down. The CPA's sized also causes it to impose a force on one connector body as it is pushed in place to push partially mated connector bodies together.

1 Claim, 11 Drawing Figures

ELECTRICAL CONNECTOR WITH POSITION ASSURANCE AND ASSIST

This invention relates to electrical connectors in general, and specifically to an electrical connector that has a pair of matable connector bodies that are locked together when fully mated.

BACKGROUND OF THE INVENTION

Electrical connectors that include a pair of matable connector bodies may have a latch that engages as the connector bodies move together to lock them at a fully mated position. An example of such a connector may be seen in the U.S. Pat. No. 4,370,013 to Niitsu et al. As there disclosed, a first connector body 1 is locked to a second, matable connector body 2 by a cantilevered barbed tongue 8 that flexes beneath and past a cross member 11. After the connector bodies are fully mated, a separate piece 3 is pushed beneath the barbed tongue 8 to prevent it from being flexed down, thus preventing the connector bodies from unlocking. The structure there disclosed is designed to work only after the connector bodies are fully mated, that is, after the barbed tongue 8 has moved fully past the cross member. However, it is possible that the connector bodies could be only partially mated, with the barbed tongue 8 stuck beneath the cross member 11.

The copending U.S. case Ser. No. 813,054, also assigned to the assignee of the present invention, discloses an electrical connector having a pair of matable connector bodies in which a cantilevered lock arm 38 on one connector body flexes beneath and past a cross member 17 on the other connector body to lock them together. The lock arm 38 is specially designed with a slot through which a connector position assurance and assist device 50 may be pushed, serving thereby to prevent the lock arm 38 from flexing down. This assures that the fully mated connector bodies remain locked together. In addition, however, should the connector bodies be only partially mated, the device 50 is designed to cooperate with the specially designed lock arm 38 to completely push the connector bodies together, assisting them to the fully mated and locked position.

The structures described above are both designed to work specifically with matable connector bodies having locks with the cantilevered type of arm. However, another type of connector has matable connector bodies provided with a different type of lock, often known in the art as a "pump handle" lock. Connectors of this type include an arm rockably pivoted to one of the connector bodies and a latching member, such as a ramp, on the other connector body. The ramp snaps past a latching end of the arm as the connector bodies are moved together to the fully mated position, thereby providing a lock. The lock is releasable by pressing an opposed operating end of the arm down, thus moving the latching end of the arm up. If the connector bodies are only partially mated, then the latching end of the arm rests on the ramp, and the lock is not fully engaged. It would be desirable to provide a connector position assurance and assist device that was specifically designed to work with this type of connector.

SUMMARY OF THE INVENTION

The subject invention provides a connector position assurance and assist device that is specifically designed to work with a pair of connector bodies having the type of lock described above.

Two embodiments are disclosed, both having first and second connector bodies that may be pushed together to a mated position. The first connector body has an arm that is rockably pivoted thereto intermediate a latching end and an opposed operating end of the arm. The operating end of the arm is spaced a normal distance away from a surface of the first connector body when the arm is in a free or unflexed state. In the particular embodiments disclosed, the arm can be moved from the free state position to a release position where the operating end is spaced closer to the first connector body surface, which in turn moves the arm latching end up. Furthermore, in the particular embodiments disclosed, the arm operating end has a projection that extends toward the first connector body surface, and is therefore spaced a first distance from the first connector body, less than the normal distance, when the arm is in the unflexed state. The projection of the arm operating end is spaced a lesser, second distance from the surface when the arm is in the release position. In addition, the arm may be moved to a biased position where the operating end projection is spaced a third, greater distance from the surface. The second connector body has a latching member, which is a sloped ramp in the embodiments disclosed. The ramp moves the latching end of the arm up and thereby moves the arm temporarily to its release position as the connector bodies are moved together. The arm remains in the release position if the connector bodies are only partially mated. The ramp latches with the latching end of the arm as the connector bodies reach the fully mated position of the connector bodies. A lock is thereby provided to keep the connector bodies together, a lock that is releasable by pressing the operating end of the arm to move the arm to the release position.

The invention provides an improvement to the above described type of electrical connector in the form of a connector position assurance and assist device. This device has a graspable handle at one end and an opposed blocking end having a thickness substantially equal to the normal spacing of the operating end of the arm. The thickness is sufficient that, when the connector bodies are fully mated and the blocking end is pushed between the operating end of the arm and the surface from which it is spaced, the force necessary to extract it will be great enough that it will be retained. The arm operating end will thereby be disabled from releasing the lock, thus assuring that the connector bodies remain fully mated. Furthermore, should the connector bodies be only partially mated, that thickness is sufficient that the force imposed on the first connector body by pushing the blocking end of the device into place will move and assist the connector bodies together to the fully mated position. In the particular embodiments disclosed, the thickness of the blocking end of the device is designed to be substantially equal to the third distance described. Therefore, when the connector bodies are fully mated and the blocking end is pushed between the projection of the arm operating end and the first connector body surface, the arm is moved to the biased position before it returns to the free state position. The blocking end of the device is then trapped by the projection. The operating end of the arm is thereby disabled from releasing the lock. In addition, that blocking end thickness assures that, when the connector bodies are only partially mated, the blocking end may not be pushed between the arm operating end projection and the surface without imposing a force on the first connector body that will first move and assist the connector bodies together to the fully mated position.

It is, therefore, a basic object of the subject invention to provide a connector position and assurance device for use with an electrical connector of the type having first and second matable connector bodies with a releasable lock.

It is another object of the invention to provide such a device for use with an electrical connector of the type described in which the releasable lock includes an arm rockably pivoted to one of the connector bodies intermediate a latching end and an operating end that is spaced a normal distance away from a surface of the one connector body, and which also includes a latching member on the other connector body that latches with the arm latching end as the connector bodies are moved together to a fully mated position.

It is yet another object of the invention to provide a connector position assurance for use with a connector having a releasable lock of the type described which includes a blocking end having a thickness sufficiently close to the normal distance of the arm operating end so that, when the connector bodies are fully mated, the blocking end may be pushed between the arm operating end and the surface and the force necessary to extract the blocking end will be great enough that it will be retained, thereby disabling the arm operating end from releasing the lock and thus assuring that the connector bodies remain fully mated, with the blocking end thickness also being sufficiently great that, when the connector bodies are only partially mated, the force imposed on the first connector body by pushing the blocking end between the arm operating end and the surface will be sufficient to move and assist the first and second connector bodies together to the fully mated position.

It is still another object of the invention to provide a connector position assurance and assist device for use with matable connector bodies having a releasable lock of the type described in which the rockably pivoted arm moves between a free state position where the operating end is spaced a normal distance from the surface and a release position where the operating end is spaced closer to the surface, and in which the latching member on the other connector body moves the arm temporarily to substantially its release position before latching with the arm latching end at the fully mated position, thereby providing a lock that is releasable by pressing the arm operating end, with the thickness of the blocking end of the connector position assurance and assist device being substantially equal to the normal distance so that, when the connector bodies are fully mated, the blocking end may be pushed between the arm operating end and the surface, and the force necessary to extract the blocking end will thereby be great enough that it will be retained, the blocking end thickness also being sufficiently greater than the closer spacing, so that, when the connector bodies are only partially mated and the arm is therefore held substantially in its release position, the blocking end may not be pushed between the arm operating end and the surface without imposing a force on the first connector body that first moves and assists the first and second connector bodies together to the fully mated position.

It is still another object of the invention to provide a connector position assurance and assist device for use with matable connector bodies having a releasable lock of the type described in which the operating end of the arm also has a projection, and in which the arm also moves to a biased position with the operating end projection spaced a third, greater distance from the surface, and in which the thickness of the blocking end of the connector position assurance and assist device is substantially equal to that third distance, so that, when the connector bodies are fully mated, the blocking end may be pushed between the arm operating end projection, moving the arm to its biased position before the arm returns to its free state position and traps the blocking end with the projection, thereby disabling the arm operating end from releasing the lock, that blocking end thickness also assuring that, when the connector bodies are only partially mated and the arm is therefore held substantially in its release position, the blocking end may not be pushed between the arm operating end projection and the surface without imposing a force on the first connector body that first moves and assists the first and second connector bodies together to the fully mated position.

DESCRIPTION OF THE PREFERRED EMBODIMENT

These and other objects and features will appear from the following written description and the accompanying drawings in which:

FIG. 1 is a perspective of the two connector bodies and the connector position assurance and assist device;

FIG. 2 is an enlarged cross sectional view of a portion of one connector body showing the free state position of the arm in solid lines and the release position of the arm in dotted lines;

FIG. 3 is a view taken along the line 3—3 in FIG. 2;

FIG. 4 is a view of the components of FIG. 1 moving together with the connector bodies shown in cross section and with the arm moved substantially to its release position, and with the connector position assurance and assist device pushing on the first connector body;

FIG. 5 is a view similar to FIG. 4, after the connector bodies have been moved to the fully mated position, and after the connector position assurance and assist device has begun to move beneath the operating end of the arm;

FIG. 6 is a view similar to FIG. 5, after the connector position assurance and assist device is in place;

FIG. 7 is a view of the components before they are moved together with the connector bodies shown in cross section;

FIG. 8 is a top plan view of the components of FIG. 7 taken along the line 8—8;

FIG. 9 is a view similar to FIG. 4, but showing the second embodiment;

FIG. 10 is a view similar to FIG. 5, but showing the second embodiment;

FIG. 11 is a view similar to FIG. 6, but showing the second embodiment.

The subject invention provides two embodiments of a connector position assurance and assist device for an electrical connector that has a pair of matable connector bodies with a releasable lock of the type generally referred to as a "pump handle" lock. The electrical connector itself is not specially designed, nor are any modifications made to it. Rather, the connector position assurance and assist device of the invention is specifically designed to take advantage of certain aspects of the operation of the lock, and to work in cooperation with certain details of its structure that already exist. Therefore, a significant advantage is gained at little additional cost. The operation of and structural details of such an electrical connector in general will be first described.

Figure 1:
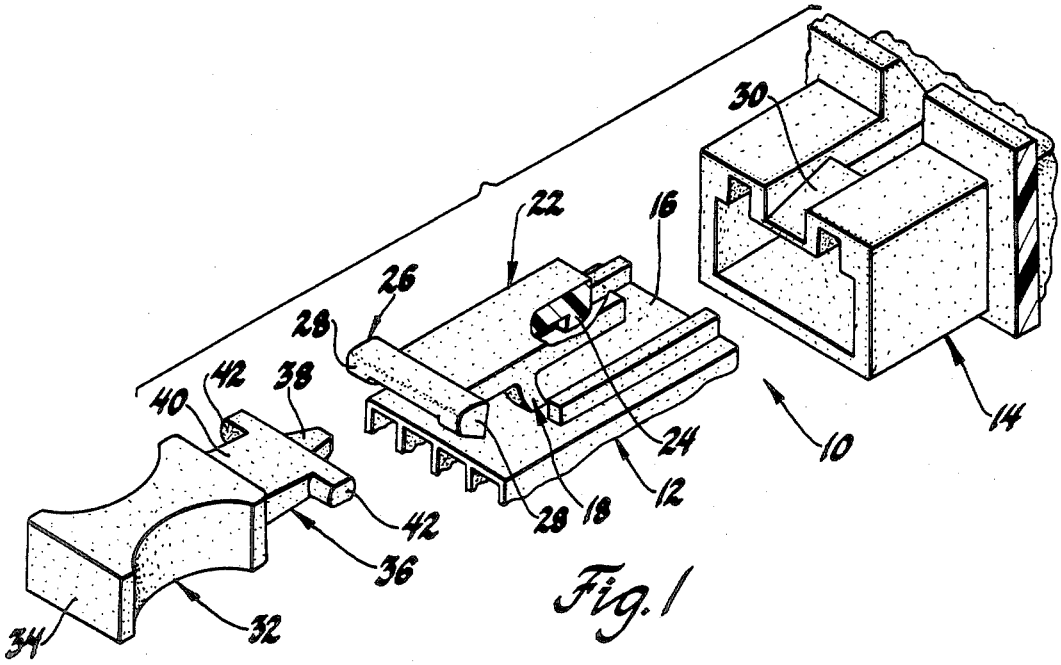
FIGS. 1–6 illustrate a first embodiment of the invention.
Figure 3:
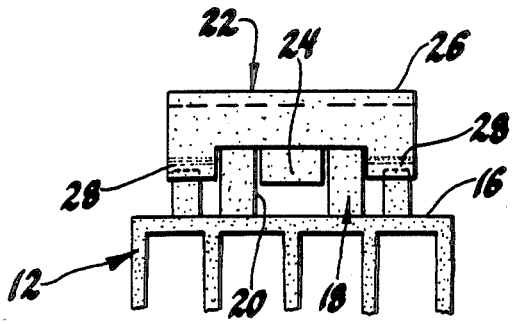

Referring first to FIGS. 1, and 3, a first electrical connector, designated generally at 10, includes a first and a second connector body, designated generally at 12 and 14 respectively, molded of plastic or other suitable dielectric material. Only a portion of the first connector body 12 is illustrated for purposes of simplicity. Connector bodies 12 and 14 are matable, by which it is meant that they interfit, one within another, and may be pushed together to a fully mated position, best illustrated in FIG. 6. Referring back to FIG. 1, the first connector body 12 has a flat upper surface 16 and a fulcrum member, designated generally at 18, molded integrally therewith. As best seen in FIG. 3, fulcrum member 18 is molded with a central slot 20 therethrough. An arm designated generally at 22 is integrally molded to the fulcrum member 18 intermediate a barbed latching end 24 and an opposed operating end 26. The operating end 26 includes a pair of spaced projections 28. Projections and slot 20 exist as a result of the method by which the first connector body 12 is molded. That molding method is best illustrated in FIG. 3, where it may be seen that the barb of the latching end 24 and fulcrum member 18 are moldable by a single pair of mold elements that can be pulled straight apart. The invention takes advantage of the structural details that result from that method of molding, as will appear below.

Figure 2:
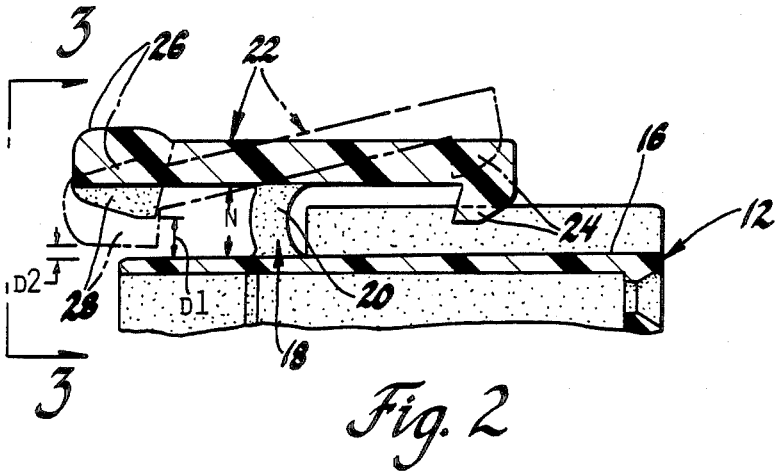

The movement of arm 22 is best illustrated in FIG. 2. Arm 22, by being molded to the fulcrum member 18, is rockably pivoted to the first connector body 12 so that its two ends move oppositely. When the arm 22 is in the solid line free or unflexed state, it is spaced a normal distance N away from the surface 16. More specifically, the projections 28, since they extend toward the surface 16, are spaced away from the surface 16 a first distance D1 when the arm 22 is in the free state, which distance is less than N. Arm 22 can be rocked counterclockwise to what may be called a release position, shown in dotted lines, where that spacing is less, and designated at D2. This rocking may occur either as a result of operating end 26 being pressed down by an operator, or as a result of the latching end 24 being pushed up. The distance D2 can vary depending on how far down operating end 26 is pressed, and may even be essentially zero if the operating end 26 is pushed down far enough, but it is always less than D1. In the embodiments disclosed, the arm 22 may also be rocked clockwise to what may be called a biased position, seen in FIG. 5. At the biased position, the projections 28 are spaced a third distance D3 from the surface 16, which is greater than D1, and approximately equal to N for the embodiment disclosed. The natural set and resilience of the arm 22 and fulcrum member 18 will return the arm 22 to its free state from either of the rocked positions.

Figure 4:
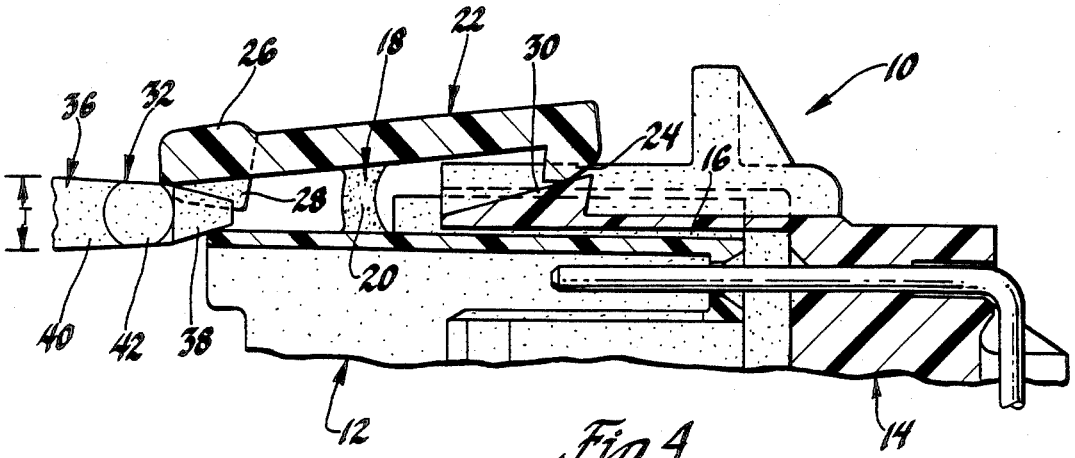
Figure 6:
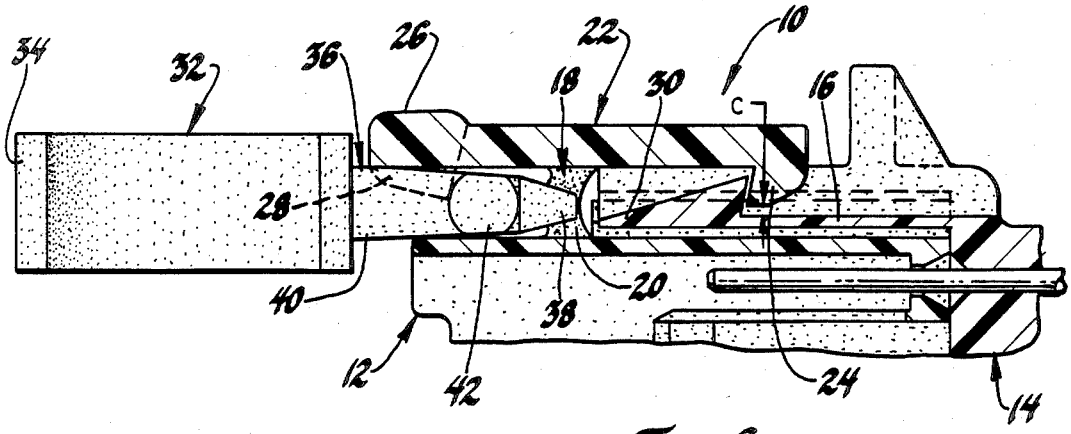

Referring again to FIG. 1, the second connector body 14 is molded with a latching member in the form of a sloped ramp 30. In practice, the second connector body 14 would be fixed, as to a vehicle body, and the first connector body 12 would be moved relative to it. Ramp 30 is oriented and located so that, as the connector bodies 12 and 14 are pushed together, it slides beneath the arm latching end 24, pushing it up and moving the arm temporarily to substantially its release position, as best illustrated in FIG. 4. Then, the ramp 30 and latching end 24 snap past one another, and the arm 22 returns to its free state as the connector bodies 12 and 14 reach the fully mated position, as seen in FIG. 6. It will be noted in FIG. 6, as well, that there is some clearance, designated C, between the arm latching end 24 and the second connector body 14. As an alternative, an operator could press the operating end 26 down and hold the arm 22 in its release position as the connector bodies 12 and 14 were pushed together, and then release the arm 22 to return to its free state at the fully mated position. Either way, the latching engagement of the arm latching end 24 and ramp 30 provides a lock to keep the connector bodies 12 and 14 in the fully mated position. An operator may later release the lock, if desired, by pressing the arm operating end 26 down to move the arm 22 to the release position. However, once the connector bodies 12 and 14 are fully mated, it would be desirable to disable the arm operating end 26 from releasing the lock. Furthermore, in the event that the connector bodies 12 and 14 are only partially mated, then the ramp 30 will rest beneath arm latching end 24 as seen in FIG. 4, and the lock will not be fully engaged. It would be desirable, in that case, to assist the connector bodies 12 and 14 to the fully mated position. The invention, described next, does both.

Figure 5:
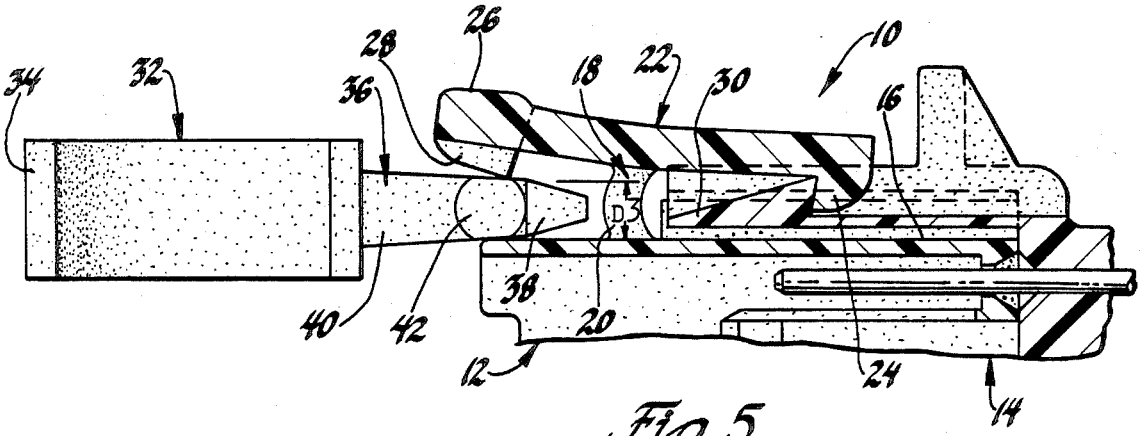

Referring now to FIGS. 1 and 4, one embodiment of the connector position assurance and assist device of the invention is designated generally at 32. The device 32, which may be conveniently referred to as a CPA, is molded of plastic and has an easily grasped, dumb bell shaped handle 34 at one end and an opposed blocking end, designated generally at 36. The blocking end 36 has generally a T shape, with a trapezoidal leading tip 38, a generally rectangular shank 40, and a pair of outwardly extending ears 42 that are generally in the shape of cylinders flattened on each side. The CPA 32 is symmetrical about a plane through its axis, as best seen in FIGS. 4-6, and may conveniently be of a color contrasting with that of the connector bodies 12 and 14. Although it tapers somewhat from the tip 38 back, the blocking end 36 has an average thickness, designated at T in FIG. 4, that is substantially equal to D3. D3 is also substantially equal to the normal spacing N of the arm operating end 26. This thickness T is deliberately chosen so that the CPA 32 may cooperate with the already existing structure of connector 10 to give the advantages noted above.

Referring next to FIG. 5, when the connector bodies 12 and 14 are fully mated, the arm 22 will initially be in its free state position, not shown in FIG. 5, with the projections 28 spaced the distance D1 from the surface 16. When an operator grasps the handle 34 of the device 32 and begins to push the blocking end 36 between the arm operating end 26 and the surface 16, the ears 42 will slide beneath the projections 28, pushing them up and away from the surface 16. This rocks the arm 22 clockwise to substantially its biased position, as shown, since the thickness of the blocking end 36 is substantially equal to the distance D3. The clearance C seen in FIG. 6 is sufficient to allow the arm 22 to rock to the biased position. Once the ears 42 move past the projections 28, the arm 22 returns to the free state position shown in FIG. 6, since T is substantially equal to N. At that point, the blocking end 36 is quite solidly held, with the ears 42 trapped by the projections 28 and confined in cooperation with the fulcrum member 18. Furthermore, part of the shank 40 is confined by the projections 28, between the undersurface of the arm 22 and the surface 16. The tip 38 is at least partially pushed into the slot 20, which braces the CPA 32 against twisting side to side in cooperation with the projections 28. The symmetry of the CPA 32 assures that it cannot be pushed in upside down, and the handle 34 is too thick for it to be put in backwards. The force necessary to extract the blocking end 36, once it is in place, will be great enough that the CPA 32 will be retained. The arm 22 will clearly, therefore, be disabled from releasing the lock, since essentially the entire space N is filled. This assures that the connector bodies 12 and 14 will remain fully mated. Of course, an operator applying sufficient force could pull the CPA 32 out, although that amount of dislodging force would not occur during normal operation of a vehicle.

A further advantage of the CPA 32 may be understood from FIGS. 4 and 5. If an operator attempts to push the CPA 32 in place when the connector bodies 12 and 14 are only partially mated, the blocking end 36 will not fit, because it is substantially thicker than the distance D2, as well as being thicker than D1. Remembering that the second connector body 14 is fixed to a vehicle body, it will be understood that the CPA 32 will impose a force on the first connector body 12 that will first move it to the right, thereby assisting the connector bodies 12 and 14 to the fully mated position of FIG. 5. Then, the blocking end 36 may be pushed between the arm operating end projections 28 and the surface 16, as has already been described above.

Figure 7:
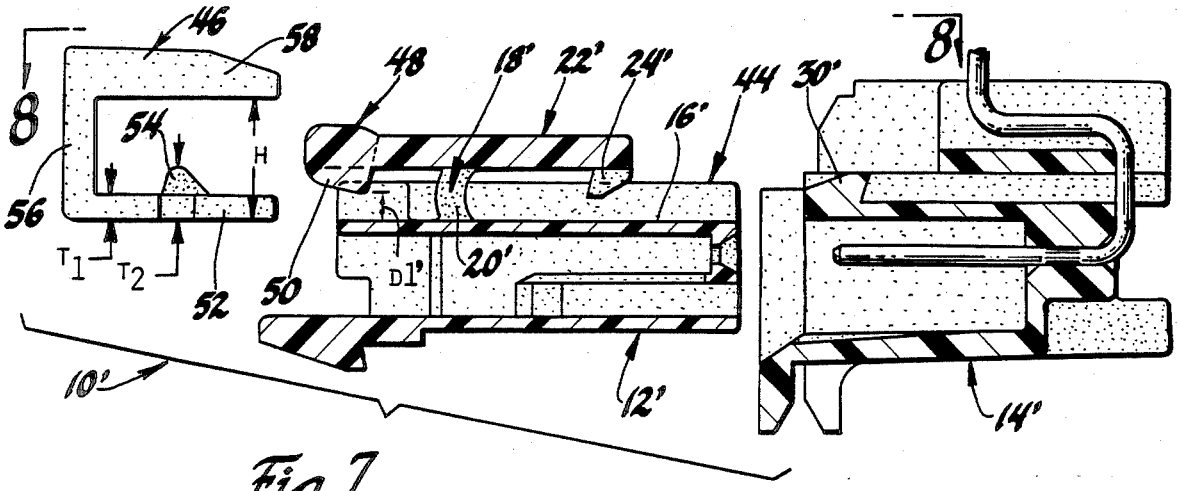
FIGS. 7–11 illustrate a second embodiment of the invention.
Figure 8:
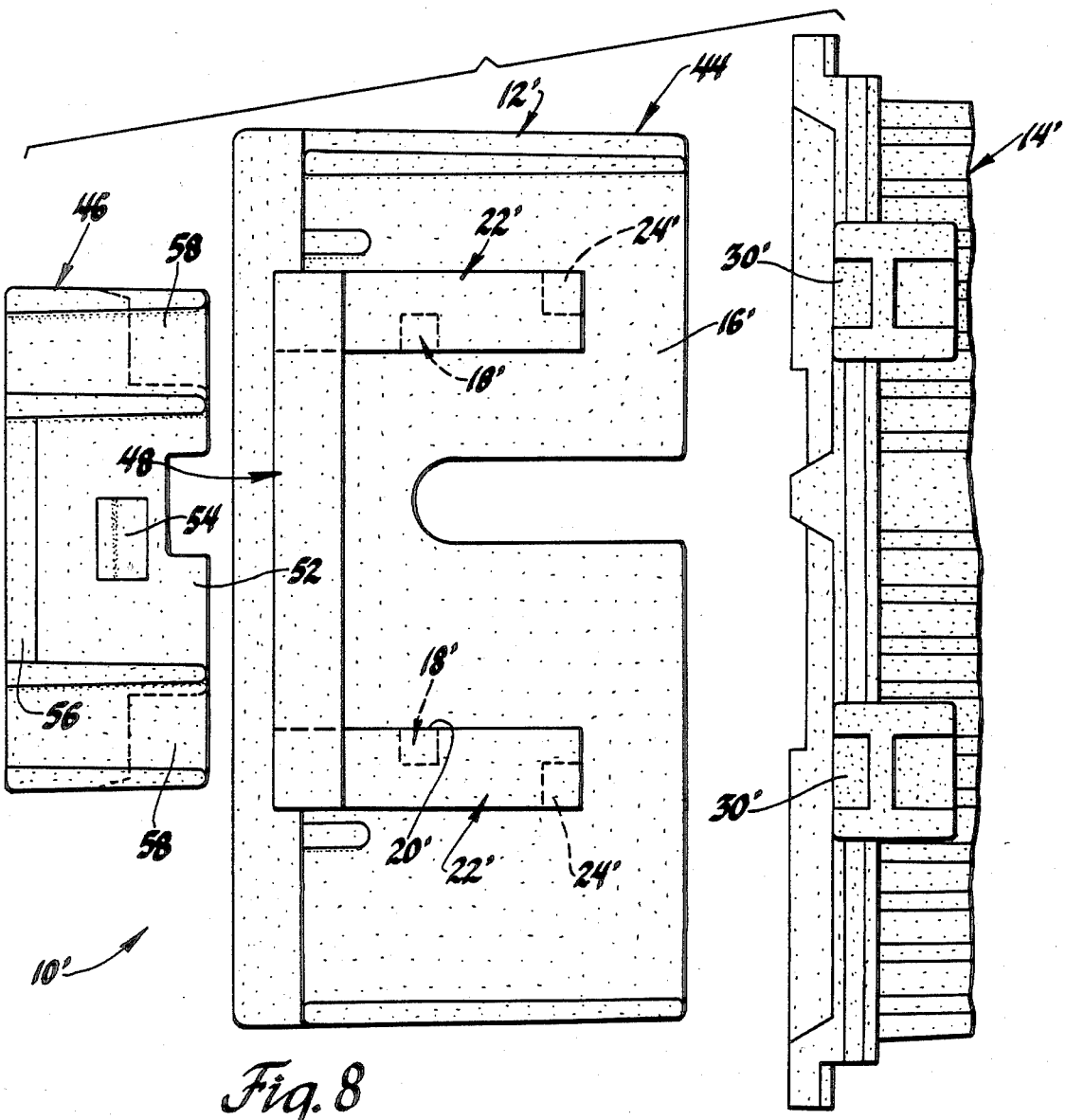

Referring next to FIGS. 7 and 8, a second electrical connector is designated generally at 44, and a second embodiment of the CPA of the invention usable therewith is designated generally at 46. The description may be more brief, because the basic operation is essentially the same. Those structural parts that are the same or very similar are given the same number with a prime (′), while those that are different are given a new number. Like the first, the second connector 44 includes first and second matable connector bodies 12′ and 14′ molded of suitable plastic, and the first connector body 12′ has a flat upper surface 16′. The basic differences in the second connector 44 are that the connector bodies 12′ and 14′ are larger, and the first connector body 12′ has not one, but a pair, of spaced apart fulcrum members 18′, as best seen in FIG. 8. There is also a pair of arms 22′, one molded to each fulcrum member 18′. Arms 22′ operate the same as arms 22, except that they are connected by a single cross bar, designated generally at 48. Cross bar 48 thereby serves as an operating end for both arms 22′, moving them simultaneously to the release position when pressed down. A single, longer projection 50 runs almost the entire length of the underside of cross bar 48, save for the ends coincident with the arms 22′. Again, the configuration of the projection 50 is a result of the molding method used. The spacings of the projection 50 from the flat surface 16′ at the various positions of the arms 22′ are basically the same as for the first connector 10, and are given parallel designations. The second connector body 14′ includes two sloped ramps 30′, which simultaneously snap past the two arm latching ends 24′ as the connector bodies 12′ and 14′ move together. Thus, approximately twice the locking force is provided to keep the larger connector bodies 12′ and 14′ together.

The second CPA 46 has certain differences from the first CPA 32 that allow it to better work in cooperation with the second connector 44, although its basic operation is the same. Still referring to FIGS. 7 and 8, the second CPA 46 is also molded of plastic, with a shank 52 that has a thickness T1 approximately equal to the distance D2′ and a width less than the spacing of the two fulcrum members 18′. The CPA 46 also has a sloped tooth 54 near the center of shank 52 which comprises its blocking end. Tooth 54 has thickness T2 substantially equal to the distance D3′. CPA 46 also has a graspable handle 56 that is generally perpendicular to the shank 52 and that has a width greater than the spacing of the fulcrum members 18′. Extending forward from the handle 56 generally parallel to the shank 52 are a pair of overhangs 58 that are spaced apart a distance substantially equal to the distance that the two arms 22′ are spaced apart. The overhangs 58 have a height H measured from shank 52 that is approximately equal to the distance D3′ plus the total thickness of the cross bar 48, for a purpose that will appear below.

Figure 9:
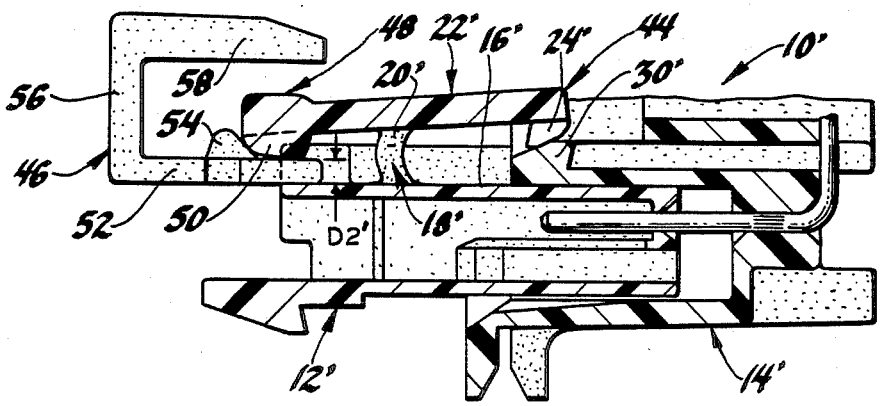
Figure 10:
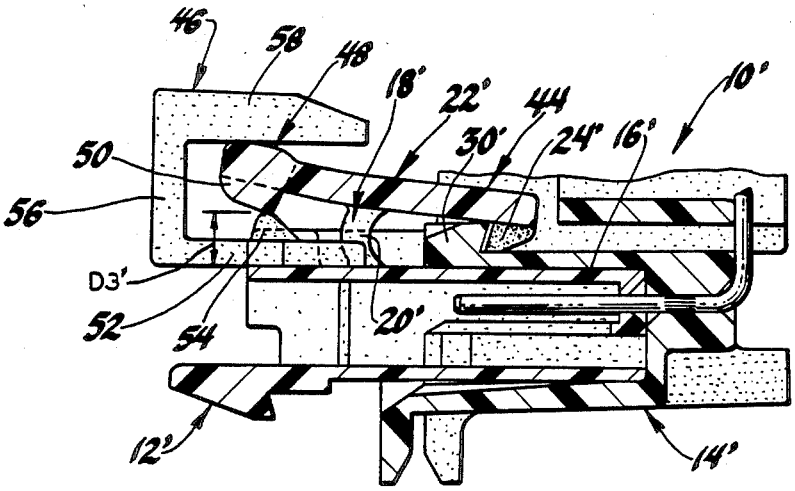
Figure 11:
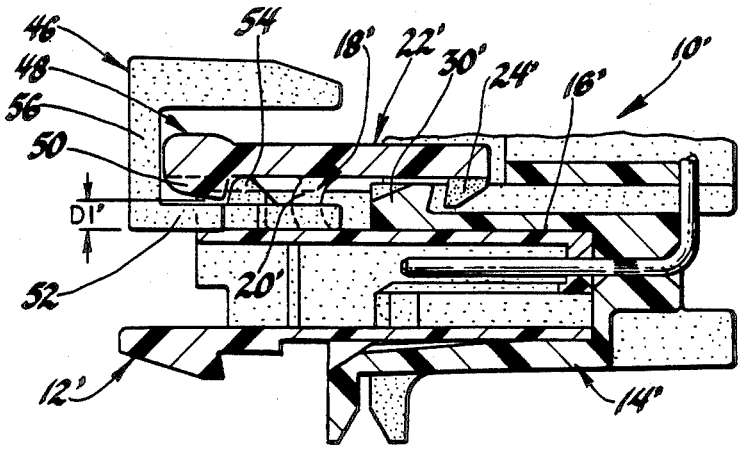

The operation of the CPA 46, which is essentially the same as the first embodiment 32, may be understood by referring to FIGS. 9–11. Referring first to FIG. 10, when the connector bodies 12′ and 14′ are fully mated, an operator grasping the handle 56 may push the tooth 54 between the projection 50 and the surface 16′ of the first connector body 12′. This pushes the cross bar 48 up and moves both arms 22′ simultaneously to substantially their biased position. The height of the overhangs 58 is sufficient that they do not interfere with upward movement of the cross bar 48. The CPA 46 clearly cannot be put in backwards because of the size of the handle 56. The CPA 46 is not symmetrical about a plane, as is the first embodiment 32, and must be put in with the handle 56 up. However, the overhangs 58 would hit the fulcrum members 18′ if the CPA 46 were attempted to be put in upside down. As seen in FIG. 11, when the CPA 46 is pushed farther to the right and the tooth 54 moves past the projection 50, the arms 22′ both move back to the free state. The tooth 54 is thereby trapped by the projection 50. As with the CPA 32, the force necessary to extract the CPA 46 is sufficient that it is retained, and the thickness T1 of the shank 52 resting beneath the projection 50 is sufficient that the cross bar 48 cannot be pushed down, and is thereby disabled from releasing the lock.

In addition, as may be seen by looking from FIG. 9 to FIG. 10, the CPA 46 will also assist the connector bodies to the fully mated position, should they be only partially mated. Since T2 is substantially equal to D3′, and therefore significantly greater than D2′, attempting to push the teeth 54 between the projection 50 and the surface 16′ when the arms 22′ are in the FIG. 9 position will impose a force on the first connector body 12′ that will move it toward the second connector body 14′ to the fully mated position of FIG. 10. Then, the CPA 46 will move from its FIG. 10 to its FIG. 11 position as has already been described. Additionally, the height of the overhangs 58 is such that they rest closely over the cross bar 48 as the CPA is so pushed in, preventing the cross bar 48 from popping up too quickly and possibly moving farther up than the distance D3′. This assures that the force of pushing the CPA 46 in place will be sufficient to fully mate the partially mated connector bodies 12′ and 14′.

Variations of the embodiments of the CPA's disclosed could be used with electrical connectors that had different releasable locks. It is not necessary that the arm operating end have a projection thereon. So long as the CPA blocking end thickness is sufficiently close to the normal spacing of the arm operating end, then the frictional force alone of pushing it in place between the operating end and the surface could provide sufficient retention. Furthermore, for the lock to be releasable, it is only necessary that the operating end be able to move the latching end up when the operating end is pushed down. It is not absolutely necessary that the reverse should hold true, as well. For example, an arm that was significantly more flexible on the latching end side of the fulcrum member might not be rocked to its release position simply by the act of pushing the connector bodies together. Therefore, the operating end of the arm might not rest significantly closer to the surface than its normal spacing when the connector bodies were only partially mated. However, so long as the CPA blocking end was sufficiently close to that normal spacing as described, then the frictional force alone caused by pushing the blocking end between the arm operating end and the surface could also be sufficient to push the partially mated connector bodies fully together. Of course, if the arm is moved to its release position when the connector bodies are partially mated, then the force imposed on the first connector body can be great enough to push the connector bodies together if the blocking end thickness is only substantially close to the normal spacing. Nor would it be absolutely necessary that there be sufficient clearance C that for the arm to have a biased position. The natural flexibility of the arm alone could be sufficient to allow the CPA blocking end to snap beneath a projection on the arm operating end. Therefore, it will be understood that the invention is capable of being embodied in and used with structures other than those disclosed, and is not intended to be so limited.

The embodiments of the invention in which an exclusive property or privilege is claimed are defined as follows:

1. In an electrical connector that includes, a first connector body having a surface and an arm, said arm having a latching end and an operating end having a projection, said arm being rockably pivoted to said first connector body intermediate its two ends for movement between a free state position where said operating end projection is spaced a first distance from said surface, a release position where said operating end projection is spaced a lesser, second distance from said surface, and a biased position where said operating end projection is spaced a third, greater distance from said surface, and, a second connector body matable with said first connector body, said second connector body having a latching member thereon that moves said arm temporarily to substantially its release position as said connector bodies are moved together before latching with said arm latching end at a fully mated position, thereby providing a lock that is releasable by pressing said arm operating end to said second distance, the improvement comprising, a connector position assurance and assist device including a blocking end having a thickness substantially equal to said third distance, so that, when said connector bodies are fully mated, said blocking end may be pushed between said arm operating end projection and said surface, moving said arm to its biased position before said arm returns to its free state position and traps said blocking end with said projection, thereby disabling said arm operating end from releasing said lock and assuring that said connector bodies remain fully mated, said blocking end thickness also assuring that, when said connector bodies are only partially mated and said arm is therefore held substantially in its release position, said blocking end may not be pushed between said arm operating end projection and said surface without imposing a force on said first connector body that first moves and assists said first and second connector bodies together to the fully mated position.

* * * * *